US012350578B1

(12) United States Patent
Enenstein

(10) Patent No.: US 12,350,578 B1
(45) Date of Patent: Jul. 8, 2025

(54) CARD HOLDER

(71) Applicant: Max Enenstein, Los Angeles, CA (US)

(72) Inventor: Max Enenstein, Los Angeles, CA (US)

( * ) Notice: Subject to any disclaimer, the term of this patent is extended or adjusted under 35 U.S.C. 154(b) by 0 days.

(21) Appl. No.: 18/644,746

(22) Filed: Apr. 24, 2024

(51) Int. Cl.
*A63F 1/10* (2006.01)

(52) U.S. Cl.
CPC ..... *A63F 1/10* (2013.01)

(58) Field of Classification Search
CPC ..... A63F 1/10; A63F 3/00895
See application file for complete search history.

(56) References Cited

U.S. PATENT DOCUMENTS 812,048 A * 2/1906 Kirby ..... A63F 3/00031 273/244.2
2,284,458 A * 5/1942 Van Antwerp ..... G09B 25/04 217/69
2,474,447 A * 6/1949 Wheelock ..... A63F 3/0423 40/657
2,577,007 A * 12/1951 Dubilier ..... A63F 1/06 229/122
2,631,042 A * 3/1953 Bertram ..... A63F 1/10 211/132.1
3,759,521 A * 9/1973 Breslow ..... A63F 3/001 273/120 R
D320,818 S * 10/1991 Anderson ..... D21/395
5,590,880 A * 1/1997 Flam ..... A63F 1/10 D21/392
6,626,432 B2 * 9/2003 Rago ..... A63F 1/10 273/287
7,607,664 B1 * 10/2009 Ward ..... A63F 3/00006 273/285
2007/0018390 A1 * 1/2007 Sumner ..... A63F 3/00028 273/281
2015/0251079 A1 * 9/2015 Wright ..... A63F 1/10 273/148 A
2016/0373848 A1 * 12/2016 Tews ..... H04R 1/1008

OTHER PUBLICATIONS

"Foldable playing card holder", published Dec. 16, 2023 by @Melic_34519 at https://www.printables.com/model/683233-foldable-playing-card-holder (Year: 2023).*

* cited by examiner

*Primary Examiner* — Michael D Dennis
(74) *Attorney, Agent, or Firm* — Foundation Law Group LLP; J D Harriman

(57) ABSTRACT

The present apparatus is a card holder that can be stored flat to fit into the packaging of any game, and then assembled to form a three sided, open top box. The three sided design allows a card to be easily slid from the card deck and easily placed on the bottom of the deck during game play. The apparatus prevents the cards from scattering from inadvertent bumps, vibrations, or other accidental movements during game play. In one embodiment, the card holder is a single piece that can be easily folded into a three dimensional shape to create the card box. In one embodiment, the card holder is comprised of multiple pieces which can be assembled to create the card box. In one embodiment, the card holder is part of the game board and can be folded down flat for storage and assembled during play.

6 Claims, 9 Drawing Sheets

CARD HOLDER

BACKGROUND OF THE SYSTEM

Many board games and other entertainments use cards as part of the game play. For example, Monopoly has cards labeled "Chance" and "Community Chest". Other games may utilize one or more decks of cards as part of the game play. Often the cards are placed on a game board or other surface, and the players will draw a card from the top periodically in response to the rules of the game. A problem arises when the cards are loose because the deck can easily be scattered or toppled by an errant hand, an inadvertent bumping of the game board, or even a roll of the dice (when dice are used in the game). It would be better to have a holder for the cards to reduce the chance of inadvertent scattering. In the prior art, there sometimes is an open top box provided for placing the cards during game play. However, it is sometimes difficult to draw a card from the top of the deck when the cards are in the box. In addition, in some games, the drawn card is to be placed on the bottom of the deck after the action on the card has been performed. It is difficult to do so in an open top box without lifting the whole deck of cards. This slows game play and creates another situation where the cards can be disturbed.

SUMMARY

The present apparatus is a card holder that can be stored flat to fit into the packaging of any game, and then assembled to form a three sided, open top box. The three sided design allows a card to be easily slid from the card deck and easily placed on the bottom of the deck during game play. The apparatus prevents the cards from scattering from inadvertent bumps, vibrations, or other accidental movements during game play. In one embodiment, the card holder is a single piece that can be easily folded into a three dimensional shape to create the card box. In one embodiment, the card holder is comprised of multiple pieces which can be assembled to create the card box. In one embodiment, the card holder is part of the game board and can be folded down flat for storage and assembled during play.

DETAILED DESCRIPTION OF THE SYSTEM

Figure 1:
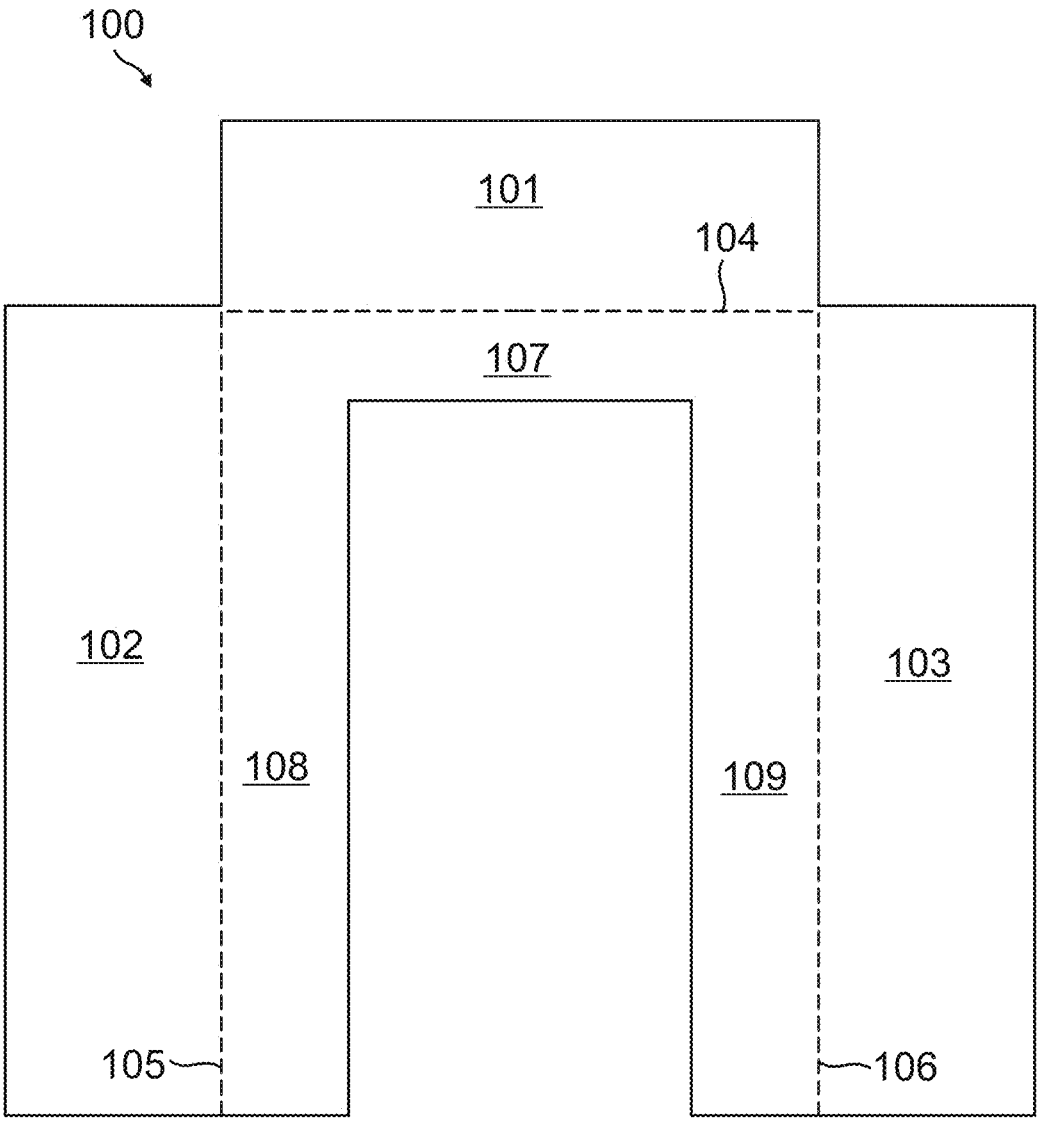
FIG. 1 is a plan view of the card holder in an unfolded position.

The present apparatus is a foldable card holder for use with board games and other uses where it is desired to hold a stack or deck of game cards. FIG. 1 illustrates a plan view of an embodiment of the card holder in an unfolded position. The card holder can lay flat, making it easy to store in a game container, file, or any other suitable location. The card holder 100 includes three wall sections 101, 102, and 103 that form vertical walls when the card holder is assembled. Fold lines 104, 105 and 106 are pre-creased locations about which the sections 101, 102, and 103 are folded up into place.

Figure 2:
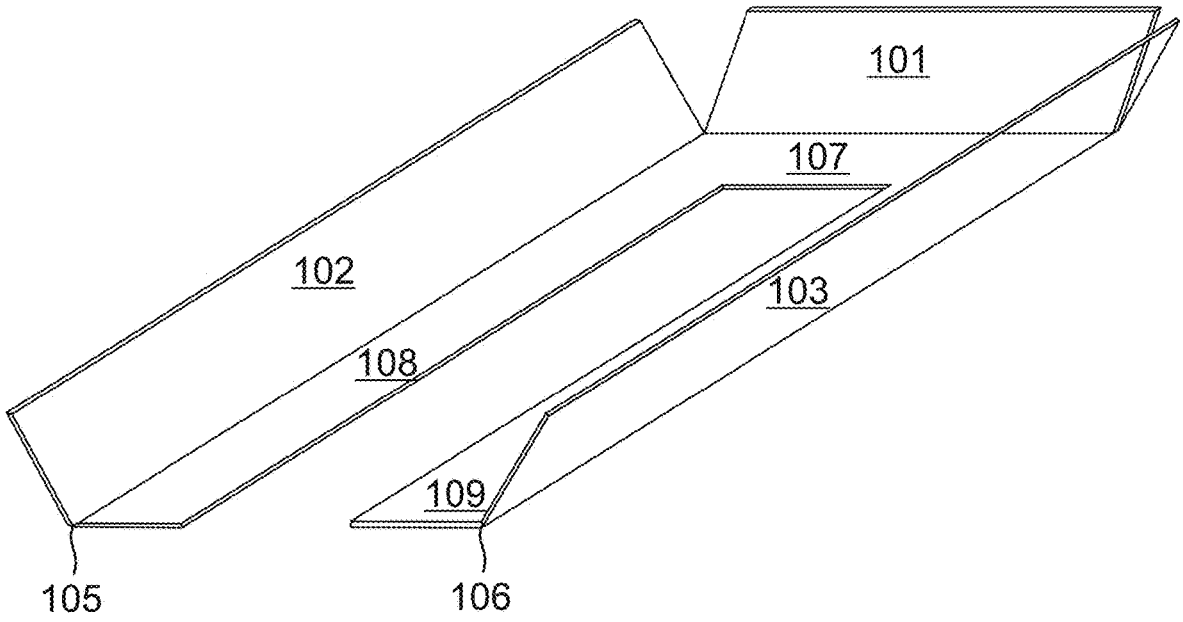
FIG. 2 is a perspective view of the card holder in a partially folded position.

Sections 107, 108, and 109 form a floor of sorts for the card holder. Referring now to FIG. 2, the card holder is shown in a partially assembled position. The vertical section 101 is folded up at fold line 104, vertical section 102 is folded up at fold line 105, and vertical section 103 is folded up at fold line 106. Sections 107, 108, and 109 remain flat.

Figure 3:
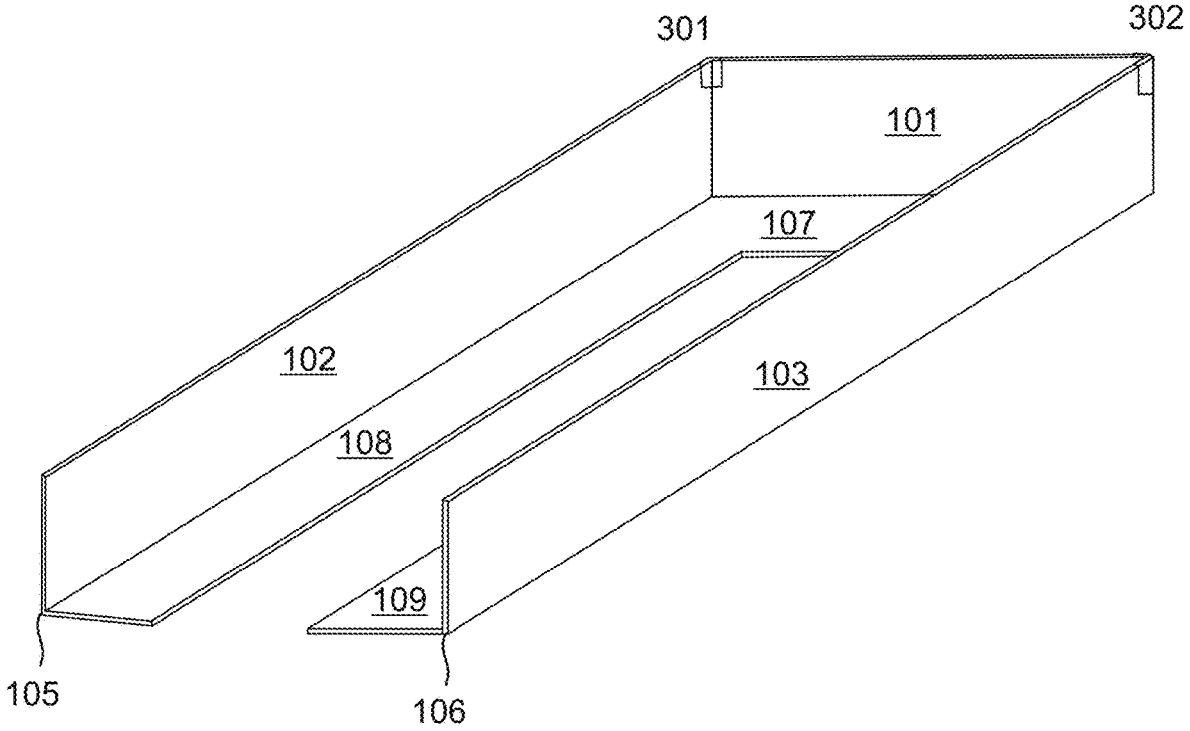
FIG. 3 is a perspective view of the card holder in position for use.

FIG. 3 illustrates the card holder in the assembled position. The apparatus forms an open top, three sided structure with a partial floor to receive the game cards. The bottom edges of the stack or deck of cards rest on floor sections 107, 108, and 109. The partial floor creates a small gap beneath the cards that makes it easier to pick up the deck or to insert a drawn card in the bottom of the deck as desired.

In one embodiment, the corners of the card holder can be held in place by a right angle clip such as clip 301 or clip 302. The clips 301 and 302 have slots formed therein at 90 degrees, and they slide over the walls of the card holder at the corner to hold the wall 101 to the walls 102 and 103 respectively.

In one embodiment, the bottom floor can be a complete floor (not shown in the Figures).

Figure 4:
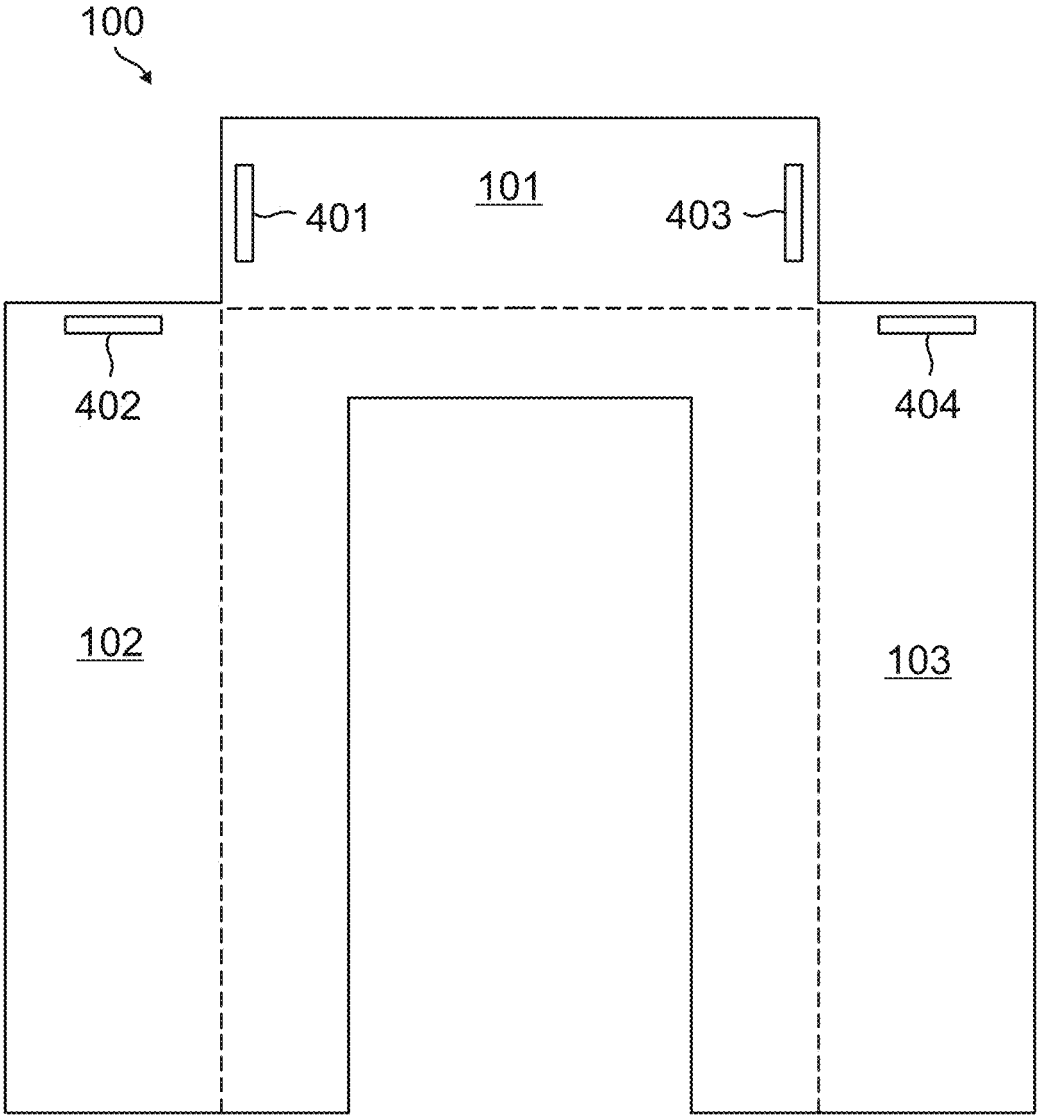
FIG. 4 is a plan view of the card holder of FIG. 1 showing an embodiment with magnets.

FIG. 4 illustrates a plan view of the card holder including magnets. Magnet 401 is disposed at the left edge of section 101. Magnet 401 engages magnet 402 that is located at the edge of section 102. When assembled, the edges will remain in place due to the attraction of the magnets. Similarly, magnet 403 of section 101 engages with magnet 404 of section 103 to keep those edges in place after assembly. In one embodiment, one of items 401 and 402 can be a magnet and the other can be a piece of metal that will stick to a magnet. The same is for pair 403 and 404. This embodiment may be used with or without the clips 301 and 302 as desired.

Figure 5:
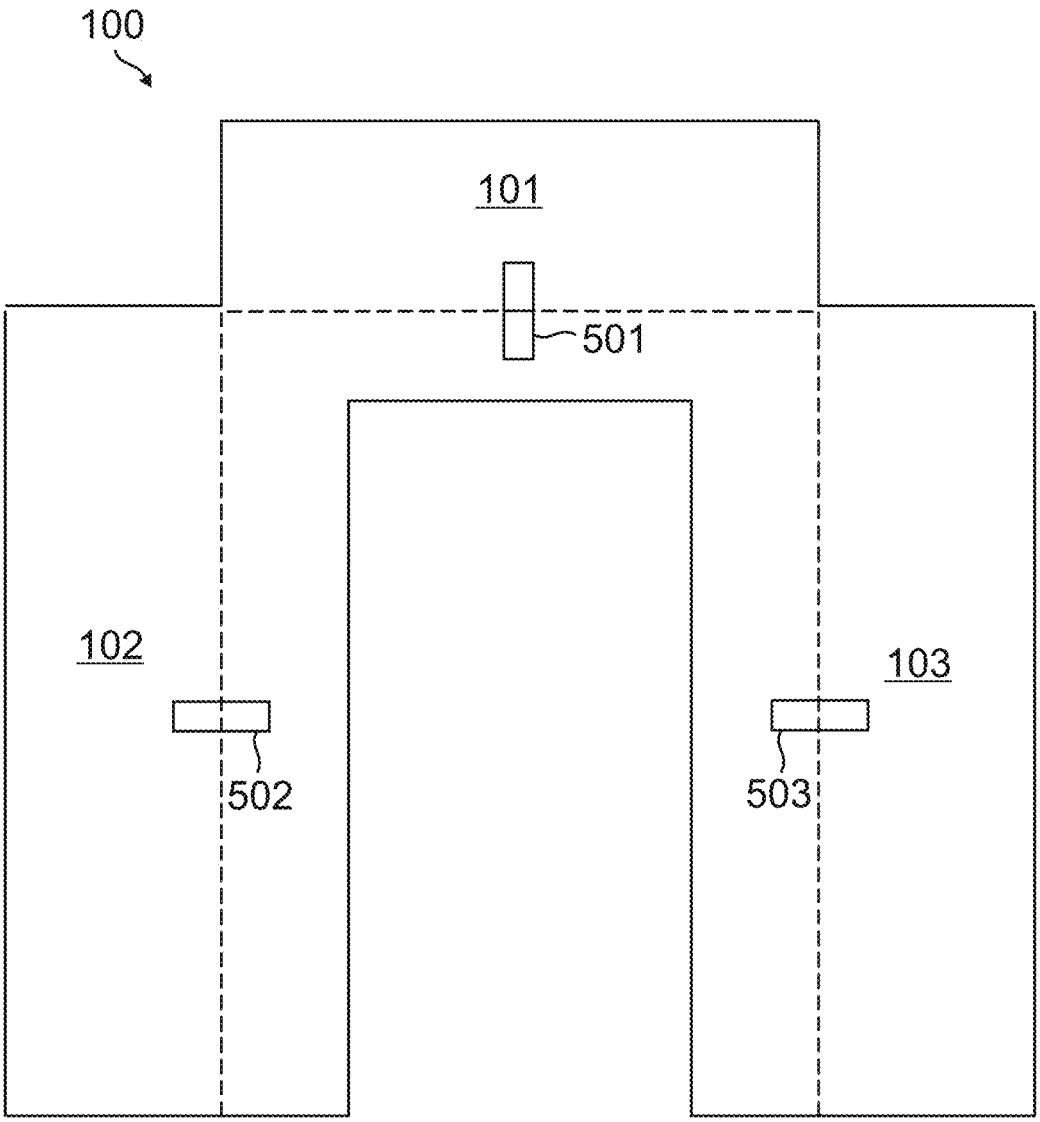
FIG. 5 is a plan view of the card holder of FIG. 1 showing an embodiment with bistable mechanisms

FIG. 5 illustrates a plan view of the card holder where a bistable mechanism is disposed across the fold lines of the apparatus. A bistable mechanism is one in which it is stable in two positions. In this case the two positions are flat (180 degrees) and at a right angle (90 degrees). When the sections 101, 102 and 103 are folded about the fold lines, the bistable mechanism will lock in place at 90 degrees, keeping the card holder structure in place during use. This embodiment may be used with or without the magnets and/or the clips as desired.

The bistable mechanism may be a pre-compressed metal strip that will move from a flat to a right angle position. In one embodiment, the bistable mechanism may be comprised of a bistable hinge that snaps to an open (180 degrees) or closed (90 degrees) position. The hinge may have detents at two locations which receive a cammed member. The detent may be overcome by the application of force to the hinge to move it from the first stable position to a second stable position and vice-versa.

Figure 6:
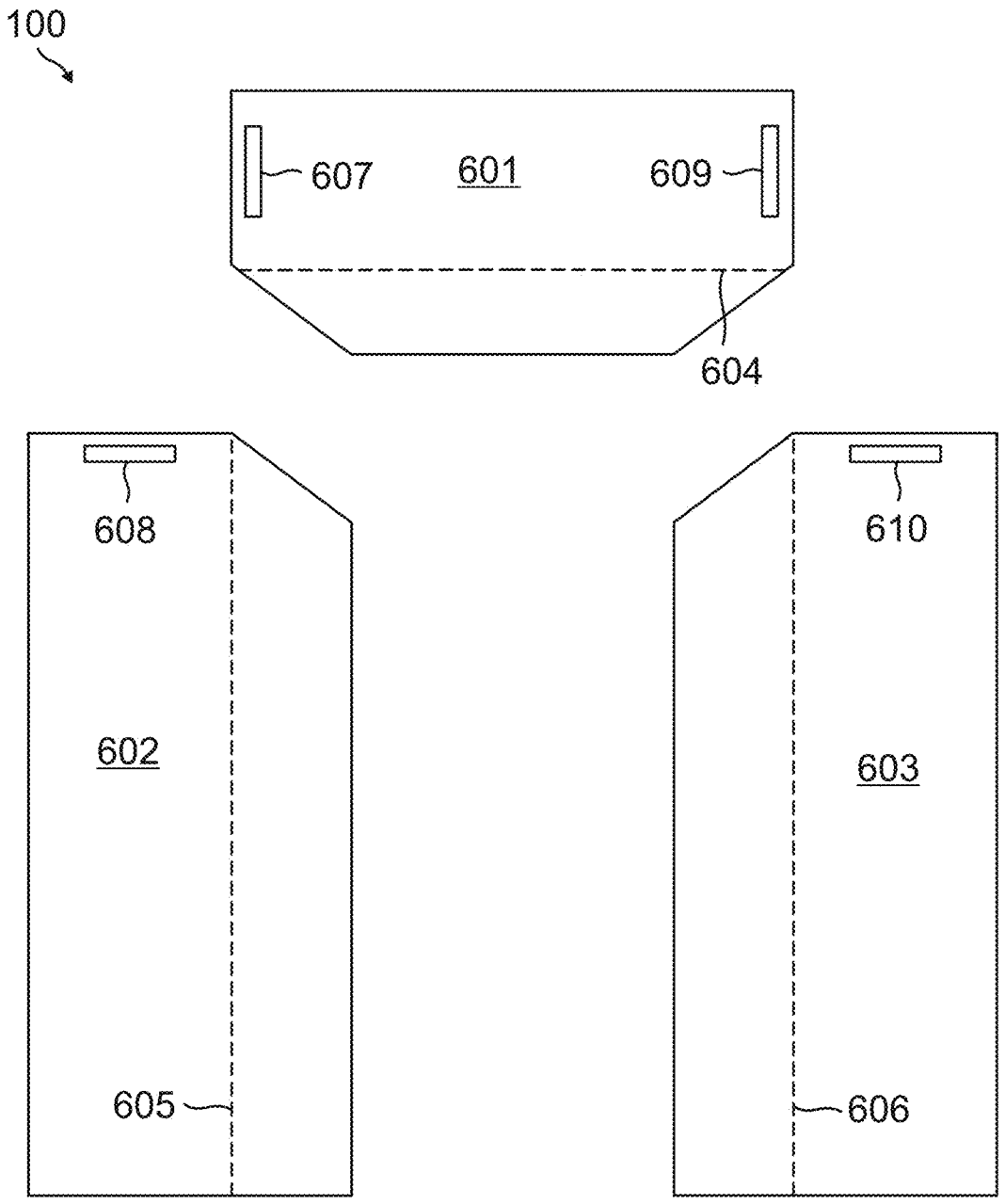
FIG. 6 is a plan view of an embodiment of a card holder in three sections with magnets.

FIG. 6 illustrates an embodiment of the card holder in three sections. This embodiment allows the card holder to be stored in a smaller space as desired. A top section 601 has a fold line 604 about which the card holder can form a 90 degree angle. Magnets 607 and 609 are embedded into the section 601 to join with magnet 608 in side section 602 and magnet 610 in side section 603 respectively. Section 602 folds about fold line 605 and section 603 folds about fold line 606.

Figure 7:
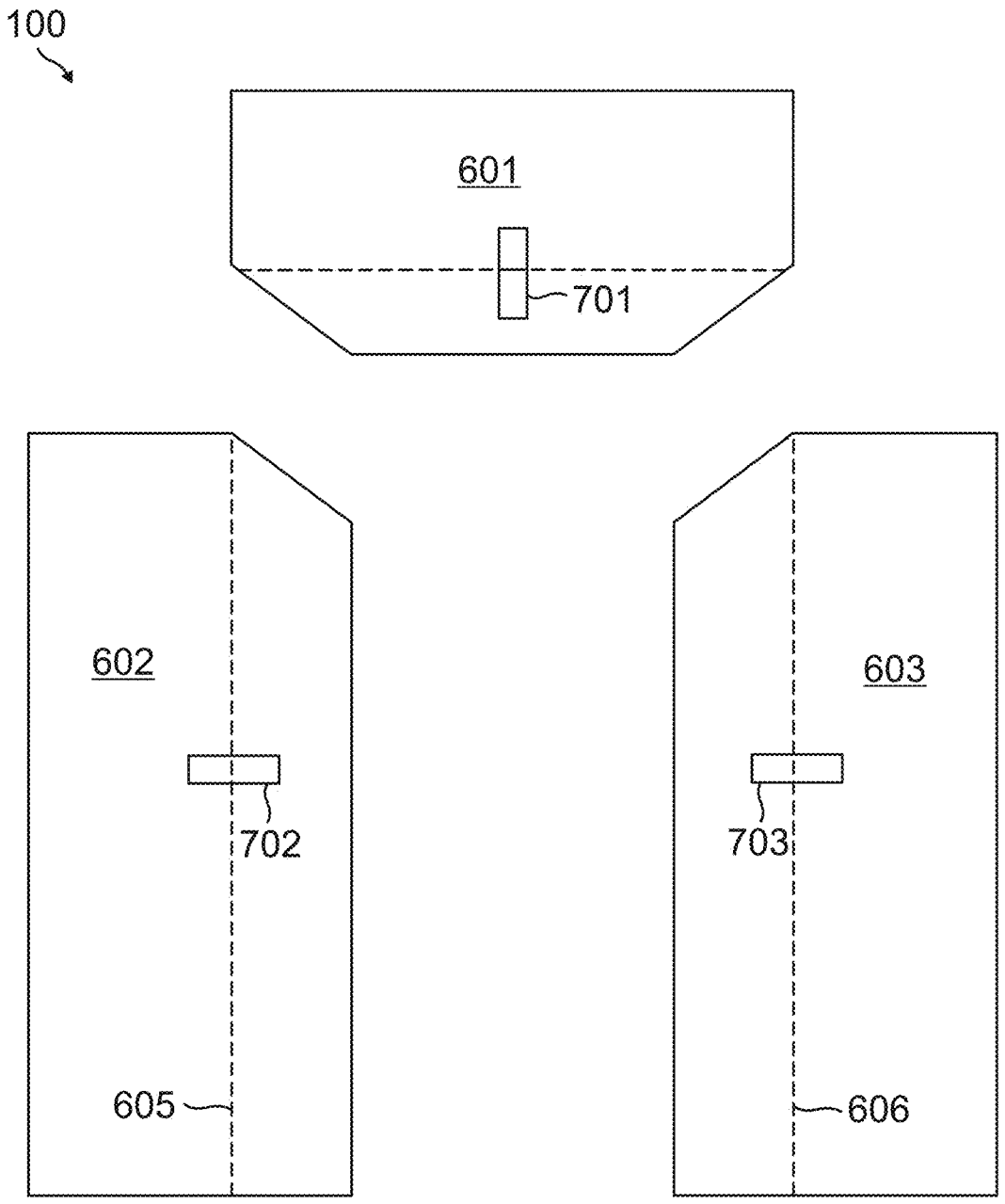
FIG. 7 is a plan view of an embodiment of a card holder in three sections with bistable mechanisms.

In one embodiment as shown in FIG. 7, the sections can include a bistable mechanism 701, 702, and 703 respectively to hold the sections at 90 degrees when in use. In this embodiment, the magnets of FIG. 6 can be used as well to provide structure to the card holder when assembled.

Figure 8:
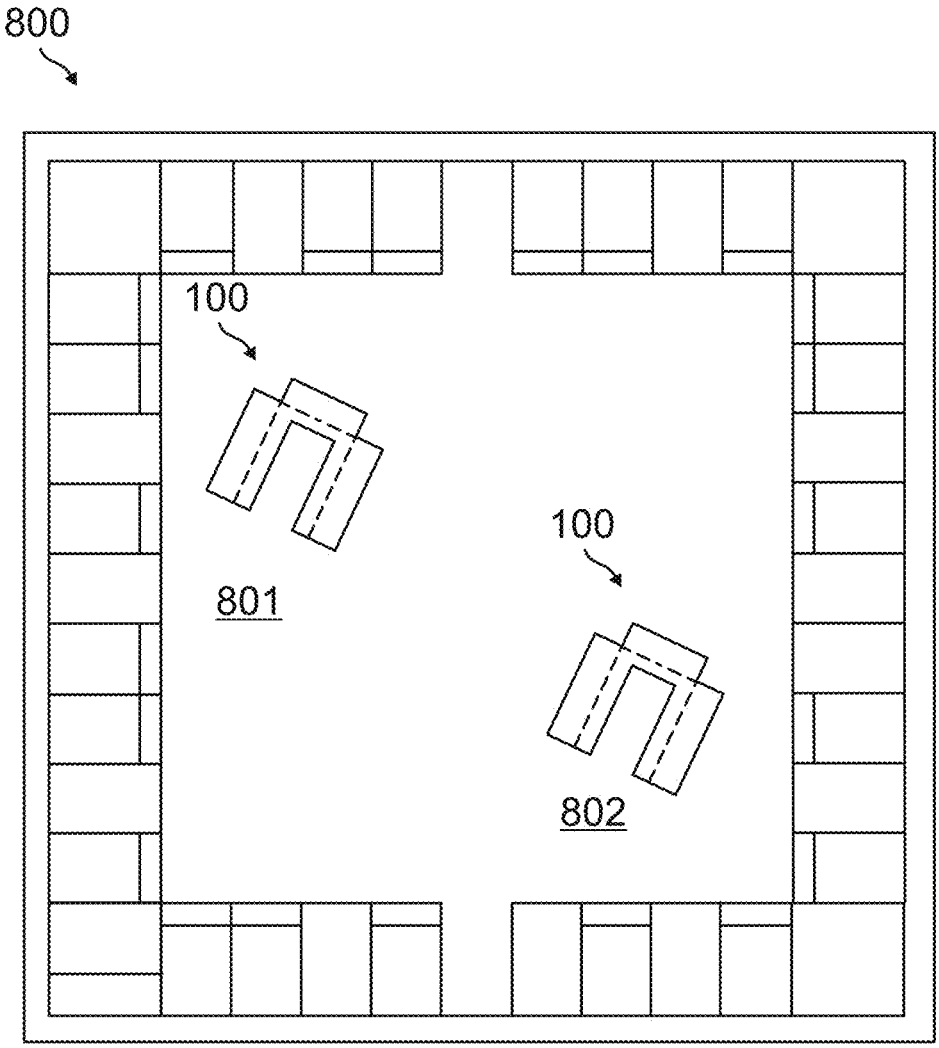
FIG. 8 is a plan view of a game board with the card holder disposed thereon.

FIG. 8 is a plan view of a game board 800. The game board 800 may have one or more defined locations for game cards, such as locations 801 and 802. In one embodiment, the regions 107, 108, and 109 of the card holder are affixed to the game board, with regions 101, 102, and 103 free to move from a flat to an upright position.

Figure 9:
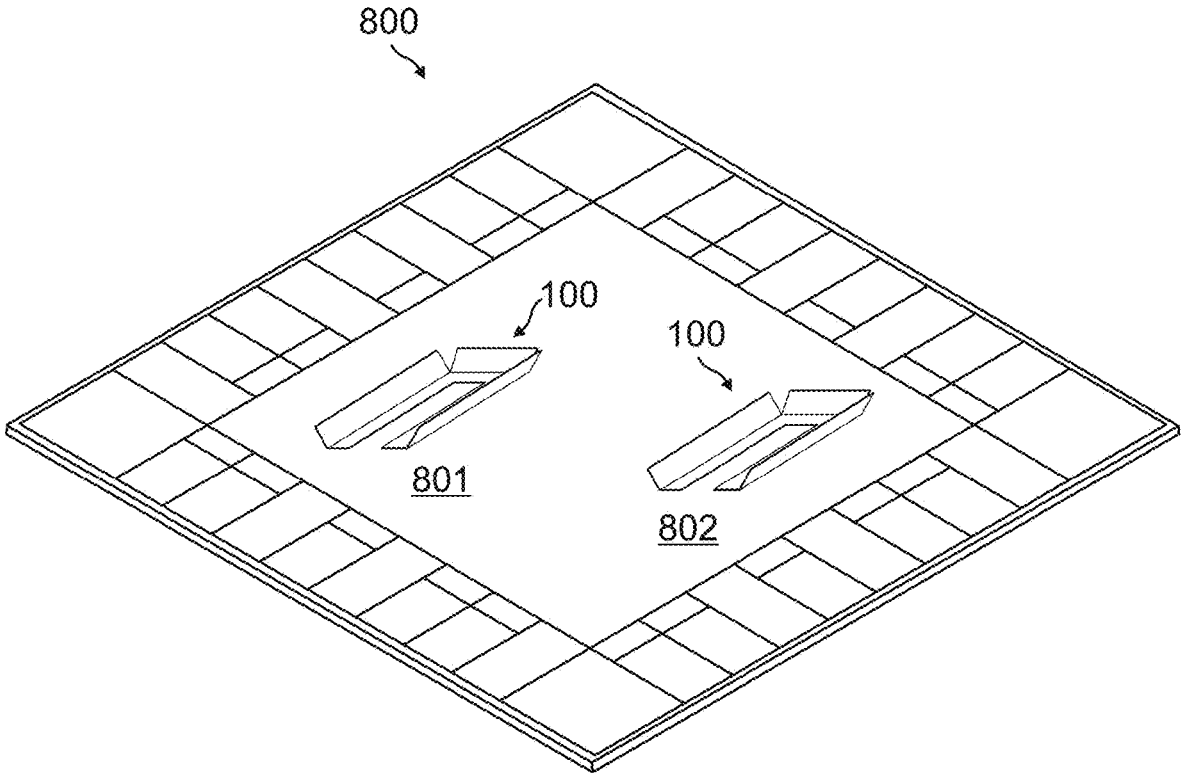
FIG. 9 is a perspective view of the card holder and game board of FIG. 8.

As seen in FIG. 9, the card holders 100 are in a partially assembled position, with regions 101, 102, and 103 lifted from the surface of the game board and ready to be locked in place by any of the desired mechanisms. At the same time, the regions 107, 108, and 109 remain affixed to the game board, The card holder may be comprised of cardboard, foam board, plastic, or of any other suitable material that forms a rigid structure when assembled.

What is claimed is:

1. A system comprising:

a game board;

a card holder, the card holder having:

a top section having a top vertical section and a top floor section disposed on opposite sides of a top fold line, the top floor section being directly affixed to the game board at a location at an interior portion of the card holder;

a first side section having a first side vertical section and a first side floor section disposed on opposite sides of a first side fold line, the first side floor section being directly affixed to the game board at a location at an interior portion of the card holder;

a second side section having a second side vertical section and a second side floor section disposed on opposite sides of a second side fold line, the second side floor section being directly affixed to the game board at a location at an interior portion of the card holder;

the first side vertical section, the second side vertical section, and the top vertical section being free to move between a flat position and an upright position;

the card holder forming a three sided box with an open end opposite the top vertical section and wherein the top floor section, the first side floor section, and the second side floor section define a U shape having an opening therein on the game board such that a portion of the game board is visible within the opening;

the card holder including a first right angle clip having slots formed therein at 90 degrees that slide over and reversibly retain a first top edge of the top vertical section to a first side edge of the first side vertical section, and;

a second right angle clip having slots formed therein at 90 degrees that slide over and reversibly retain a second top edge of the top vertical section to a second side edge of the second side vertical section.

2. The system of claim 1 wherein the top section, first side section, and second side section are separate pieces.

3. A system comprising:

a game board;

a card holder, the card holder having:

a top section having a top vertical section and a top floor section disposed on opposite sides of a top fold line, the top floor section being directly affixed to the game board at a location at an interior portion of the card holder;

a first side section having a first side vertical section and a first side floor section disposed on opposite sides of a first side fold line, the first side floor section being directly affixed to the game board at a location at an interior portion of the card holder;

a second side section having a second side vertical section and a second side floor section disposed on opposite sides of a second side fold line, the second side floor section being directly affixed to the game board at a location at an interior portion of the card holder;

the first side vertical section, the second side vertical section, and the top vertical section being free to move between a flat position and an upright position;

the card holder forming a three sided box with an open end opposite the top vertical section and wherein the top floor section, the first side floor section, and the second side floor section define a U shape having an opening therein on the game board such that a portion of the game board is visible within the opening;

the card holder including a first magnet at a first vertical edge of the top vertical section reversibly engaging a second magnet at a first side edge of the first side vertical section to reversibly hold the top vertical section and the first side vertical section in the upright position; and, the card holder including a third magnet at a second vertical edge of the top vertical section reversibly engaging a fourth magnet at a second side edge of the second side vertical section to reversibly hold the top vertical section and the second side vertical section in the upright position.

4. The system of claim 3 wherein the top section, first side section, and second side section are separate pieces.

5. A system comprising:

a game board;

a card holder, the card holder having:

a top section having a top vertical section and a top floor section disposed on opposite sides of a top fold line, the top floor section being directly affixed to the game board at a location at an interior portion of the card holder;

a first side section having a first side vertical section and a first side floor section disposed on opposite sides of a first side fold line, the first side floor section being directly affixed to the game board at a location at an interior portion of the card holder;

a second side section having a second side vertical section and a second side floor section disposed on opposite sides of a second side fold line, the second side floor section being directly affixed to the game board at a location at an interior portion of the card holder;

the first side vertical section, the second side vertical section, and the top vertical section being free to move between a flat position and an upright position;

the card holder forming a three sided box with an open end opposite the top vertical section and wherein the top floor section, the first side floor section, and the second side floor section define a U shape having an opening therein on the game board such that a portion of the game board is visible within the opening;

the card holder further including a first bistable mechanism disposed on the top fold line, a second bistable mechanism disposed on the first side fold line, and a third bistable mechanism disposed on the second side fold line, and wherein the first, second, and third bistable mechanisms reversibly maintain the top vertical section, the first side vertical section, and the second side section vertical section at the upright position.

6. The system of claim 5 wherein the top section, first side section, and second side section are separate pieces.

* * * * *